US009273590B2

(12) United States Patent
Krug et al.

(10) Patent No.: US 9,273,590 B2
(45) Date of Patent: Mar. 1, 2016

(54) COMPRESSOR COMPRISING A PRESSURE-RELIEF GROOVE

(71) Applicant: Magna Powertrain Bad Homburg GmbH, Bad Homburg (DE)

(72) Inventors: Michael Krug, Gau-Bischofsheim (DE); Jan Hinrichs, Friedrichsdorf (DE)

(73) Assignee: Magna Powertrain Bad Homburg GmbH, Bad Homburg (DE)

( * ) Notice: Subject to any disclaimer, the term of this patent is extended or adjusted under 35 U.S.C. 154(b) by 0 days.

(21) Appl. No.: 14/216,781

(22) Filed: Mar. 17, 2014

(65) Prior Publication Data

US 2014/0196683 A1 Jul. 17, 2014

Related U.S. Application Data

(63) Continuation of application No. PCT/EP2012/004039, filed on Sep. 26, 2012.

(30) Foreign Application Priority Data

Oct. 5, 2011 (DE) ..... 10 2011 114 904

(51) Int. Cl.
*F01P 1/00* (2006.01)
*F04B 39/00* (2006.01)
(Continued)

(52) U.S. Cl.
CPC ..... *F01P 1/00* (2013.01); *F04B 27/1081* (2013.01); *F04B 39/12* (2013.01)

(58) Field of Classification Search
CPC ..... F25B 31/00; F25B 41/043; F25B 49/022; Y10S 277/91; F04B 39/12; B60H 2001/327; F16K 15/025; F16K 17/30; F16K 31/00; F16K 31/12; F16K 39/00
USPC ..... 123/198 C; 417/572, 222.1, 222.2, 269, 417/270, 43
See application file for complete search history.

(56) References Cited

U.S. PATENT DOCUMENTS 3,652,191 A * 3/1972 King ..... F04C 27/001 418/125
4,844,703 A * 7/1989 Watanabe ..... F04C 28/14 417/12

(Continued)

FOREIGN PATENT DOCUMENTS

DE 198 07 691 A1 10/1998
DE 102 31 211 A1 2/2003

(Continued)

OTHER PUBLICATIONS

International Preliminary Report on Patentability received for PCT/EP2012/004039 dated Apr. 17, 2014.

(Continued)

*Primary Examiner* — Lindsay Low
*Assistant Examiner* — Long T Tran
(74) *Attorney, Agent, or Firm* — Dickinson Wright PLLC

(57) ABSTRACT

A compressor is disclosed. In one aspect, the compressor includes a pressure chamber which is delimited by at least two housing parts, the housing parts including sealing surfaces that are connected by a connection device which applies a contact pressing force between the sealing surfaces. At least one groove extending in a circumferential direction is arranged on at least one sealing surface. At least one relief opening is arranged on at least one of the housing parts. The relief opening connects the groove to the surroundings of the compressor and emanates from the groove. The groove is arranged such that when a predetermined maximum pressure is exceeded in the pressure chamber, a pressure-building medium can gather in the groove and at least partially escape through the relief opening.

20 Claims, 4 Drawing Sheets

(51) Int. Cl.

| | |
|---|---|
| ***F04B 1/26*** | (2006.01) |
| ***F04B 39/12*** | (2006.01) |
| ***F04B 27/10*** | (2006.01) |

(56) References Cited

U.S. PATENT DOCUMENTS

| | | | | |
|---|---|---|---|---|
| 6,554,581 | B2 * | 4/2003 | Hinrichs | F04B 39/121 417/269 |
| 7,174,719 | B2 * | 2/2007 | Kim | F01D 11/003 415/174.3 |
| 7,762,792 | B2 * | 7/2010 | Tadano | F01C 21/0809 417/410.3 |
| 7,837,449 | B2 * | 11/2010 | Tadano | F01C 21/0809 417/410.3 |
| 2002/0076342 | A1 | 6/2002 | Hinrichs et al. | |
| 2003/0086792 | A1 * | 5/2003 | Kamiya | F04B 27/0878 417/222.2 |
| 2004/0191080 | A1 * | 9/2004 | Weber | F04B 27/1081 417/269 |
| 2006/0078442 | A1 * | 4/2006 | Ogasawara | F04C 18/3568 417/410.3 |
| 2009/0116975 | A1 | 5/2009 | Kock | |

FOREIGN PATENT DOCUMENTS

| | | | |
|---|---|---|---|
| DE | 10 2006 016 318 | A1 | 10/2007 |
| EP | 1 297 256 | A1 | 4/2003 |
| JP | 2000120950 | A * | 4/2000 |
| WO | WO 01/65070 | A2 | 9/2001 |

OTHER PUBLICATIONS

International Search Report in International Application No. PCT/EP2012/004039 dated Nov. 7, 2013.

* cited by examiner

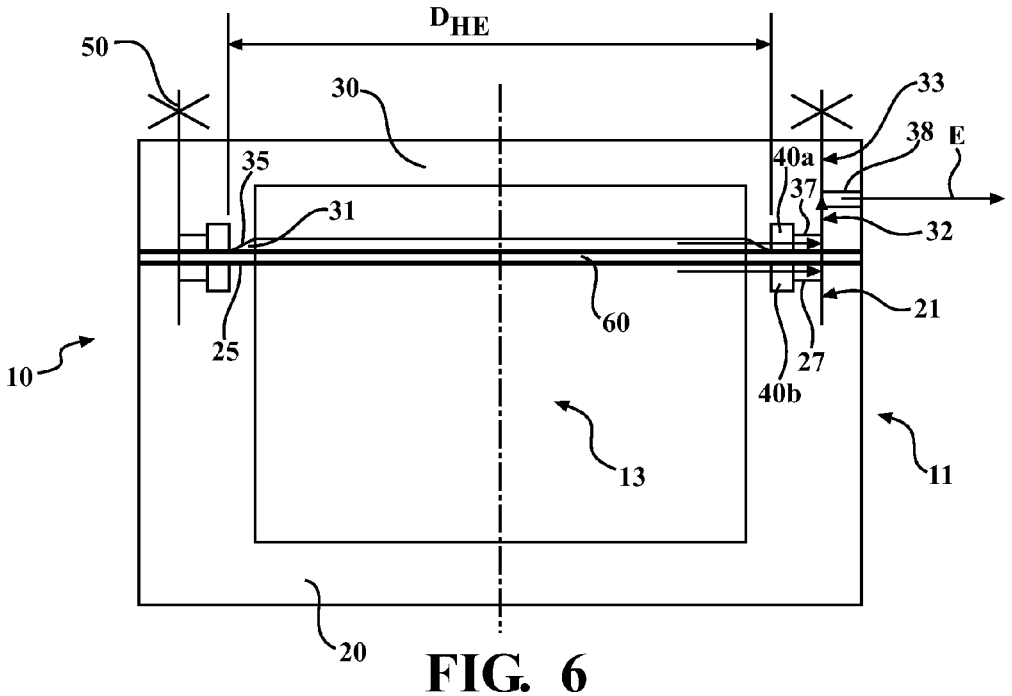
FIG. 6
FIG. 7A
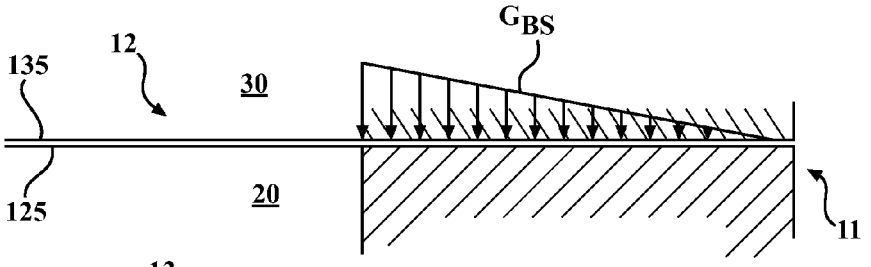
FIG. 7B
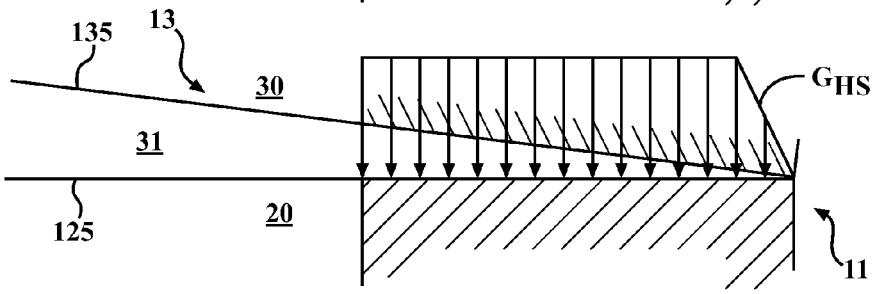
FIG. 7C
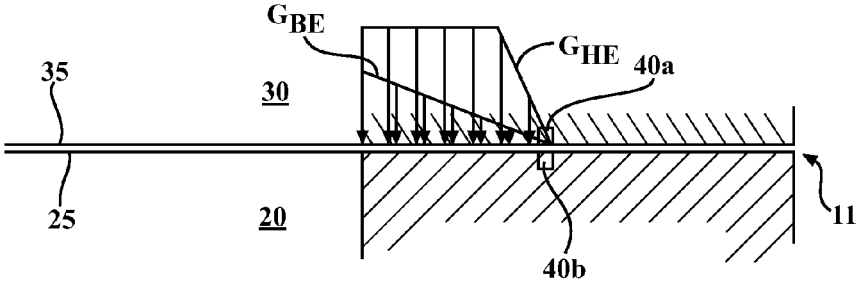

COMPRESSOR COMPRISING A PRESSURE-RELIEF GROOVE

CROSS-REFERENCE TO RELATED APPLICATIONS

This application is a continuation application, and claims the benefit under 35 U.S.C. §§120 and 365 of PCT Application No. PCT/EP2012/004039, filed on Sep. 26, 2012, which is hereby incorporated by reference. PCT/EP2012/004039 also claimed priority from German Patent Application No. DE 10 2011 114 904.3 filed on Oct. 5, 2011, which is hereby incorporated by reference.

BACKGROUND

1. Field

The described technology generally relates to a compressor with a pressure chamber which is separated by at least two housing parts, more particularly, a compressor for use in an air conditioning of a motor vehicle.

2. Description of the Related Technology

Compressors of this type are known. Its pressure chamber is delimited by at least two housing parts, which are connected by a connection device which applies a contact pressure force between the sealing surfaces.

DE 102 31 211 A1 discloses such a compressor, where several housing parts forming the pressure chamber are screwed together. Screwing of the housing parts is a simple and cost effective way of connecting the housing parts on which the pressure is applied on. However, the above compressors are often constructed in such a way that high internal pressures are applied on in operation or in the case of a malfunction requiring an extensive and a space consuming configuration of the screw connections for connecting the housing parts to exclude a potential unwanted detachment of a housing part.

EP 1 297 256 B1 discloses a safety device for compressor, which can avoid pressures overstraining the strength of the connection between the housing parts. However, this safety device requires the installation of additional components in the compressor and thus entails an increase of the required installation space and weight.

In the DE 198 07 691 A1 a compressor with an at least two part housing for an air conditioning of a motor vehicle is disclosed, which has a sealing device that is inserted into the face of a second housing part.

SUMMARY OF CERTAIN INVENTIVE ASPECTS

One inventive aspect is an improved compressor.

Another aspect is a compressor comprising a pressure chamber which is delimited by at least two housing parts and, for example, it is intended for or suitable for use in an air conditioning of a motor vehicle. The housing parts have sealing surfaces, which are connected by a connecting device which applies a contact pressure force between the sealing surfaces. On at least one sealing surface of the at least one housing part is arranged a groove extending in the circumferential direction. In addition, at least one vent opening is arranged on the at least one housing part, which connects this groove with the environment of the housing, wherein the at least one vent opening extends from the groove extending in circumferential direction, and wherein the groove is arranged in such a way that on exceeding a predetermined pressure in the pressure chamber the pressurization medium, for example, a refrigerant, accumulates in the groove and can at least partly escape through the vent opening.

Another aspect is a compressor for use in an air conditioning of a motor vehicle, for example, an electric or hybrid powered vehicle. The compressor can also be applied for air conditioning in a vehicle with an internal combustion engine. Furthermore, the compressor can also be applied for air conditioning systems for stationary applications, for example, buildings, or for pressurized casings used for other applications.

To avoid pressure forces acting radially outward on a thinner walled area, this sealing device has a groove into which a seal ring is inserted. By the safety device it is ensured that the pressure in the pressure chamber cannot reach the thinner walled area. For safety, a relief opening is provided in this wall area, via which the refrigerant being at the second wall area can be discharged into the environment.

A typical compressor has no vent opening arranged in the groove extending in the circumferential direction, but it has only a vent opening, which is spaced apart from the groove. For the compressor according to some embodiments, the vent opening extends directly from the groove extending in the circumferential direction, so that in the whole groove extending in the circumferential direction there the pressure is substantially the pressure of the environment of the compressor.

The compressor can include a device by which a refrigerant for an air conditioning system, for example, a motor vehicle can be compressed—thus can be condensed. Such a compressor, also called half hermetic, can have a rotor device, which is driven by a shaft to compress the refrigerant. The shaft can be arranged completely inside the housing of the compressor. The rotor device is arranged in the housing of the compressor, which has several housing parts, for example, at least a housing pot and a housing cover. These housing parts delimit the pressure chamber of the compressor. For that purpose, the sealing surfaces are arranged on those areas of the housing parts, which are in contact to each other and which by a connection device apply a sufficiently high pressure to each other to delimit at normal operating pressure the pressure chamber against the environment of the compressor. The sealing surfaces can be planar.

The pressure chamber can have a volume delimited by the housing parts within which a rotor device of the compressor is arranged. The pressurization in the pressure chamber is done by compression of a pressurization medium, for example, of the refrigerant of the compressor, by the rotor device of the compressor.

The housing parts can include parts, which form in its entirety the housing of the compressor, which delimits the pressure chamber against the environment, for example, in regard to a transmission of a refrigerant. In some embodiments, the compressor housing comprises two or more housing parts. The boundary surfaces of the separate housing parts have sealing surfaces against each other.

The sealing surface of a housing part can include a surface of the housing part, which is adjacent to a corresponding sealing surface of another housing part in such a way that a sufficiently high contact pressure force between the two sealing surfaces can be applied when connecting the two sealing surfaces by a connecting device, and that up to reaching a predetermined maximum pressure due to, for example, the construction of the compressor it is prevented that the pressurization medium in the pressure chamber, for example, the refrigerant escapes.

The connecting device can include a device by which a contact pressure force between the sealing surfaces of the housing parts of the compressor can be applied. In some embodiments, a connecting device has several connecting elements, which apply the contact pressure force between the sealing surfaces. A pressurization housing having housing parts, which are connected by detachable connection elements is referred to as a half-hermetic housing.

The contact pressure force between the sealing surfaces of the housing parts can include a force which counteracts the mutual removal of separate housing parts from each other under the influence of the pressurization medium in the pressure chamber. The surface pressure resulting from the contact pressure force applied by the connecting device in a sealing surface of the compressor can be more than twice as large as the force acting against this surface pressure, wherein that force is generated by applying the maximum operating pressure between the connected housing parts. The contact pressure force also causes that the pressurization medium, for example, the refrigerant cannot escape between the housing parts.

The maximum pressure in the pressure chamber of the compressor can be the pressure for which, on its application in the pressure chamber, the connecting device can barely secure a sufficient contact pressure force between the sealing surfaces of the housing parts, with a predetermined safety, for example, a reserve of the contact pressure force. This can counteract the forces acting to release the connection between the sealing surfaces and which are transmitted by the maximum pressure and in this way to prevent the pressurization medium, for example, the refrigerant from escaping upon reaching the maximum pressure.

The groove extending in the circumferential direction in the sealing surface of the housing part can include a groove excluding a volume which extends from the sealing surface, for example, from the level of the sealing surface into the housing part allocated with the sealing surface, wherein the surface area the groove extending into extends in the circumferential direction between an inner edge contour closing the sealing surface and an outer edge contour closing the sealing surface. The groove is constructed in such a way that the pressurization medium can be collected in the groove when on exceeding the maximum pressure the pressurization medium escapes from the pressure chamber and that at least partially it can escape through a vent opening. The diameter of the groove can be constructed in such a way that at the maximum operating pressure the housing parts are not diverged up to the groove.

The vent opening can include an opening which connects the groove extending in the circumferential direction to the environment of the compressor. The vent opening is constructed as a channel which can guide the pressurization medium and which has been excluded for relieving pressure from the housing parts or connecting device or it is constructed as a volume which has been already arranged in recesses for passing through of elements of the connecting device. The vent opening, for example, the radial inner end thereof extends from the groove extending in the circumferential direction. The term "extends" can mean that the vent opening is not spaced apart from the groove, for example, one of the channel or recesses of the vent opening.

The environment of the housing can include an area on which is applied substantially atmospheric pressure, for example, an area which is characterized by the normal ambient conditions in the installation room of air conditioning, especially in a motor vehicle.

Under application of a pressure, for example, under an application of a pressure close to the maximum pressure, the connecting elements of the connecting device of the compressor may expand, whereupon a gap may arise at the sealing surfaces facing the pressure chamber. As long as the pressure does not exceed the maximum pressure, the whole pressurization medium will remain in the pressure chamber. On reaching the maximum pressure, the pressurized parts of the housing parts of the sealing surfaces will become larger by the diverging of the housing parts and therefore the force counteracting to the contact pressure force of the connecting device rises.

In some embodiments, in order to limit the pressurized area to a defined extent, the groove extending in the circumferential direction is arranged in at least one sealing surface of one housing part and be brought into contact with the environment of the compressor through a vent opening, so that a pressure relief can take place, once the housing parts at their sealing surfaces diverge to the position of the groove.

In some embodiments, the connecting device has several connecting elements. These connecting elements can protrude through recesses in the sealing surfaces of the housing parts to be connected. The center points of these recesses can be arranged in substantially equidistant from the edge contour of the sealing surface, which is facing the pressure chamber.

The connection elements can include elements by which a contact pressure force between the sealing surfaces of different housing parts can be applied. In some embodiments, the connection elements are constructed as screws or bolts and protrude through recesses, which are arranged in the sealing surfaces of the housing parts to be connected. In some embodiments, the connection elements are constructed as brackets, which are attached to designated and, for example, constructed coupling areas of the housing parts to be connected on the side facing the environment. To apply the necessary contact pressure force, these brackets can be constructed with corresponding spring properties.

The recesses in the sealing surfaces of the housing parts to be connected can include recesses, which extend from the surface of the sealing surface or through the housing part. In some embodiments, these recesses are constructed as grooves or holes are, for example, through-holes or blind holes. In the case of using screws as connecting elements, the recesses may exhibit also an internal thread, which is suitable for screwing with a screw. In the case of using of bolts as connecting elements, the recesses may exhibit also fits, which are suitable to dowel the recess with the bolt used.

In some embodiments, the groove extending in the circumferential direction has a constantly larger distance or a constantly smaller distance or a constantly substantially identical distance or a variable distance to the inside of the housing in regard the recesses and, for example, in regard to the center points.

In some embodiments, the vent opening is formed by at least a relieving channel in at least one of the sealing surfaces, wherein relieving channel extends from the groove extending in the circumferential direction to the environment of the compressor.

The relieving channel can include a channel which extends from the groove extending in the circumferential direction in a sealing surface and which can discharge a medium from the pressure chamber, for example, a refrigerant from the groove extending in the circumferential direction directly or indirectly on the environment. For example, a discharge is provided from the groove extending in the circumferential direction through the relieving channel to one or more further relieving channels, to a recess for the connecting element, or to further volumes connected with the environment or directly into the environment of the compressor.

In some embodiments, the vent opening is formed by a relieving channel in at least one of the sealing surfaces, wherein the relieving channel extends from the groove extending in the circumferential direction to the recess for the connecting element.

In some embodiments, at least one of the connection elements is constructed and arranged in such a way that the medium which has been accumulated in the groove extending in the circumferential direction can escape into the environment of the compressor. For a configuration of the connecting device as a screwing connection, the medium can escape through a connecting passage recess in at least one housing part and that a groove is provided, for example, in the direction of the screw head. When using a pass connection, however, the medium escapes through the groove in at least one of the bolts used for doweling or in at least one of the recesses of the housing part which has been doweled with bolts.

In some embodiments, the vent opening has at least one relieving channel, which extends from least one of the recesses for the connecting elements, for example, through holes of at least one of the housing parts to the environment of the compressor. For example, such a relieving channel is provided if the groove extending in the circumferential direction is spaced substantially identical to the inside of the housing as to the corresponding through hole wherein the groove leads to at least one through hole.

In some embodiments, at least one sealing element is arranged in the groove extending in the circumferential direction. The groove can be arranged near to the pressure chamber of the compressor.

The sealing element can include an element, which is provided in the case of entering of the pressurization medium in the groove extending in the circumferential direction up to a predetermined maximum pressure for preventing a discharge of the pressurization medium, for example, a refrigerant, a $CO_2$ containing refrigerant or $CO_2$.

BRIEF DESCRIPTION OF THE DRAWINGS

Exemplary embodiments can be seen from the following description in connection with the figures.

FIG. 6 illustrates a compressor including the relieving groove at maximum pressure according to another embodiment.

FIG. 7*a* illustrates the radial pressure gradient in the sealing surface between two housing parts of the typical compressor at operating pressure.

FIG. 7*b* illustrates the radial pressure gradient in the sealing surface between two housing parts of the typical compressor at maximum pressure.

FIG. 7*c* illustrates the radial pressure gradients in the sealing surface between two housing parts of the compressor at the operating pressure and at the maximum pressure according to some embodiments.

DETAILED DESCRIPTION OF CERTAIN ILLUSTRATIVE EMBODIMENTS

Figure 1:
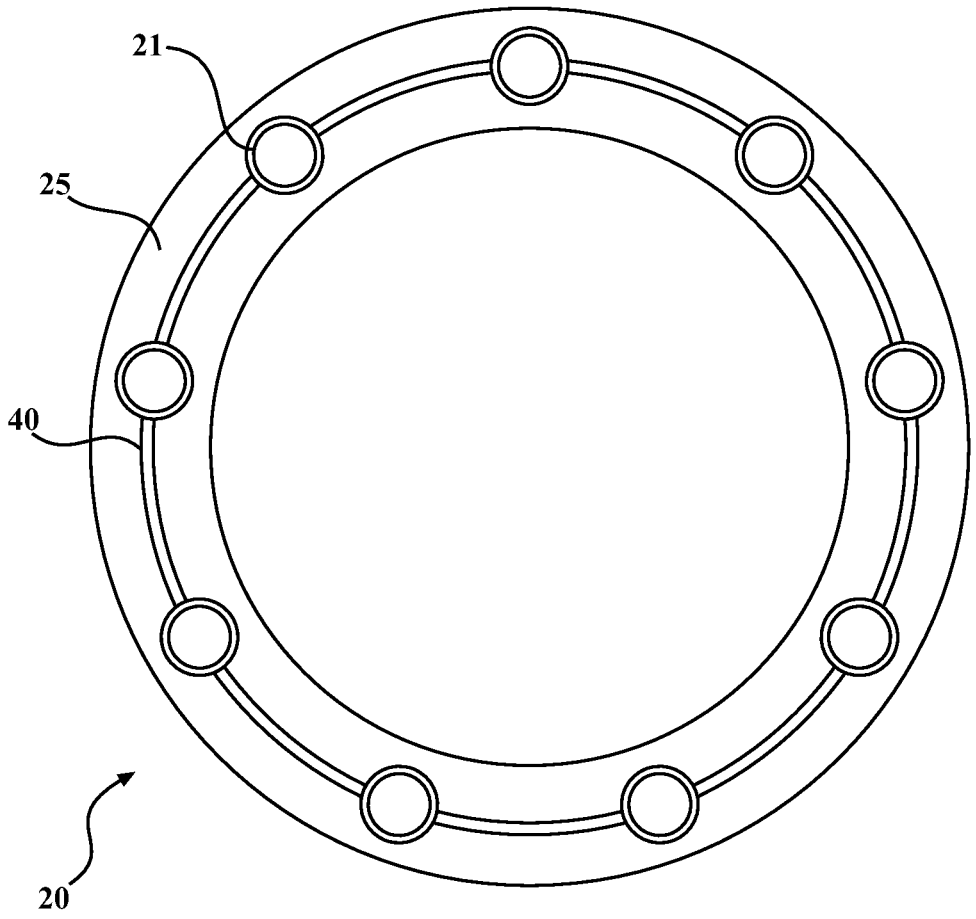
FIG. 1 illustrates a sealing surface of a housing part of a compressor according to one embodiment.

FIG. 1 shows a sealing surface 25 of a housing 20 of a compressor 10 according to one embodiment. The sealing surface 25 is planar and delimited by two essentially concentric circles with different radii. In the sealing surface 25 several recesses of screw holes 21 are arranged, wherein these screw holes 21 are extending orthogonally from the sealing surface of 25 into the housing 20. For this embodiment, nine screw holes excluded from the housing 20 in the sealing surface 25 are arranged in substantially equal distances on the circumference of the sealing surface 25. The radial distances of the individual screw holes 21 from the inner edge of the sealing surface are substantially identical. The sealing surface of 25 has a groove 40 according to some embodiments. This groove 40 extends in the circumferential direction of the housing 20 or the sealing surface 25, respectively in an substantially constant radial distance to the inner edge of the sealing surface. For the described embodiment, the groove 40 extends in the sealing surface of 25 in the radial position, in which the screws holes 21 are also arranged. Therefore, the groove 40 cuts all nine screws holes 21 of housing 20 and is disrupted in nine positions. The radial width of the groove 40 is small in relation to the radial width of the screw hole 21.

Figure 2:
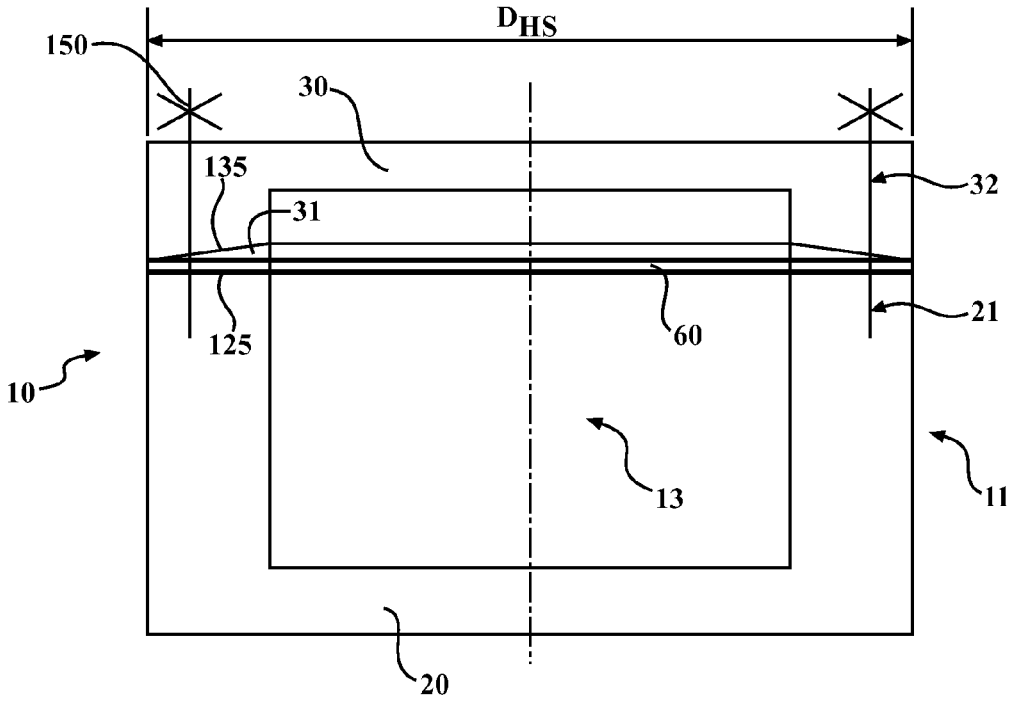
FIG. 2 illustrates a typical compressor at maximum pressure.

FIG. 2 shows a typical compressor 100 with a pressure chamber under a maximum pressure 13. This compressor 10 includes a housing 20 and a housing cover 30. The housing 20 and the housing cover 30 are connected in such a way that inside of the compressor 10 a pressure chamber 13 is formed, wherein a rubber metal sealing 60 is arranged in the range of the sealing surfaces 125 and 135. The two housing parts 20 and 30 are connected using several housing screws 150, which are inserted through screw holes 32 in the housing cover 30 and are screwed in the threaded holes 21 in the housing 20. In FIG. 2, the compressor is shown with the application of the maximum pressure corresponding to the bursting pressure. In this operating mode, the sealing surfaces of the housing cover 135 and the housing diverge by surface pressure on the inner walls of the pressure chamber 13 of the compressor 10 applied by the maximum pressure. By this way a gap 31 between the two sealing surfaces 135 and 125 is formed. Through the opening of this gap of 31 a pressurization medium E can enter from the original pressure chamber into this gap and apply there a surface pressure against the connection pressure applied by the housing screws 150. For the maximum pressure, thus the diameter of the pressurized area in the compressor $D_H$ increases. For the typical compressor 10, it is therefore necessary to make the dimensions so big that it can withstand the rising surface pressure for the same time increasing diameter of the pressurized area as long as until only the outer edge $D_{HS}$ is sealed to avoid a failure of the screw connection.

Figure 3:
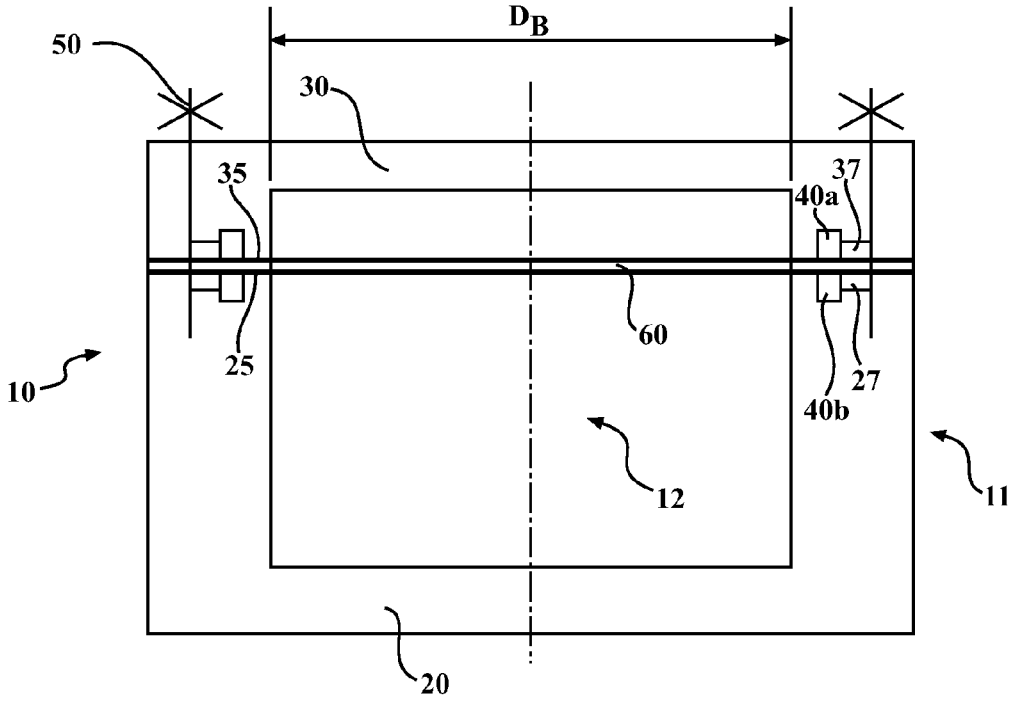
FIG. 3 illustrates a compressor comprising a relieving groove at operating pressure according to one embodiment.

FIG. 3 shows a compressor 10 with a relieving groove at operating pressure according to one embodiment. The configuration shown here differs from the compressor 10 of FIG. 2 in that the housing screws 50 are constructed smaller which because of the arrangement of the grooves 40*a* and 40*b* in the sealing surfaces 35 and 25 according to some embodiments need not be constructed as large as the connecting screws 150 of FIG. 2. The compressor 10 of FIG. 3 is shown with a pressurization at the operating pressure in the pressure chamber 12 so that the diameter of the pressurized surface at operating pressure $D_B$ is less than the diameter $D_{HS}$ shown in FIG. 2 since at the operating pressure, the sealing surfaces 35 and 25 of the housing cover 30 and the housing 20 does not diverge. In some embodiments, the compressor 10 includes a groove 40*a* in the sealing surface 35 of the housing cover 30 and a groove 40*b* in the sealing surface 25 of the housing 20. These grooves extend in the circumferential direction of the respective sealing surface, and extend in the embodiment over the entire circumference. At each position in the periphery of the respective sealing surface, on which are arranged the threaded holes 21 and screw through holes 32, a discharge channel 27 or 37 extends in the radial direction in the sealing surface of the housing 20 or of the housing cover 30. The grooves 40*a* and 40*b* are constructed such that pressurization medium E can accumulate in them. Similarly, the relieving channels 27 and 37 are formed such that they can conduct the pressurization medium E of the respective groove 40 to the screws through holes 32.

Figure 4:
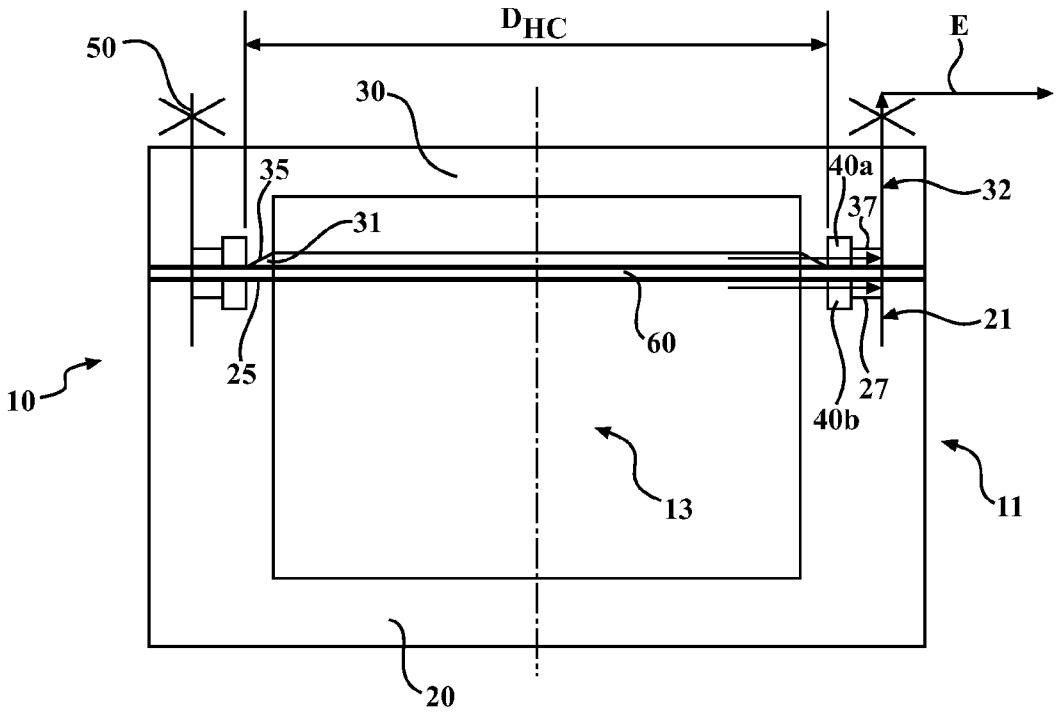
FIG. 4 illustrates a compressor including the relieving groove of FIG. 3 at maximum pressure according to one embodiment.

FIG. 4 shows the compressor of FIG. 3 with application of the maximum pressure on the pressure chamber 13 according to one embodiment. In this operating mode, the housing parts 20 and 30 diverge in the region of the inner sealing surfaces 25 and 35 so that a gap 31 is formed. By the formation of this gap 31, the diameter of the pressurized surface is enlarged to the diameter of $D_{HE}$, which is smaller than the diameter of the pressurized surface $D_{HS}$ at maximum pressure in the compressor 10 of FIG. 2. At maximum pressure, the gap 31 opens between the sealing surfaces 25 and 35 radially outwardly to the grooves 40*a* and 40*b*, after which those are filled with pressurization medium E, which is discharged through the relieving channels 27 and 37 to the respective screw through hole 32 and via those it can escape into the surroundings 11 of the compressor 10. For example, a groove is provided in the head of those housing screws 50 of which screws through holes 32 the pressurization medium is con-ducted. The radial position of the grooves 40*a* and 40*b* limits the maximum possible diameter $D_{HE}$ of the pressurized area and the maximum pressure in such a way that a smaller construction of the housing screws 50 is possible because the force which can be applied and which may detach the screw connection parts 21, 30 and 50 is also limited by the limitation of the diameter $D_{HE}$.

Figure 5:
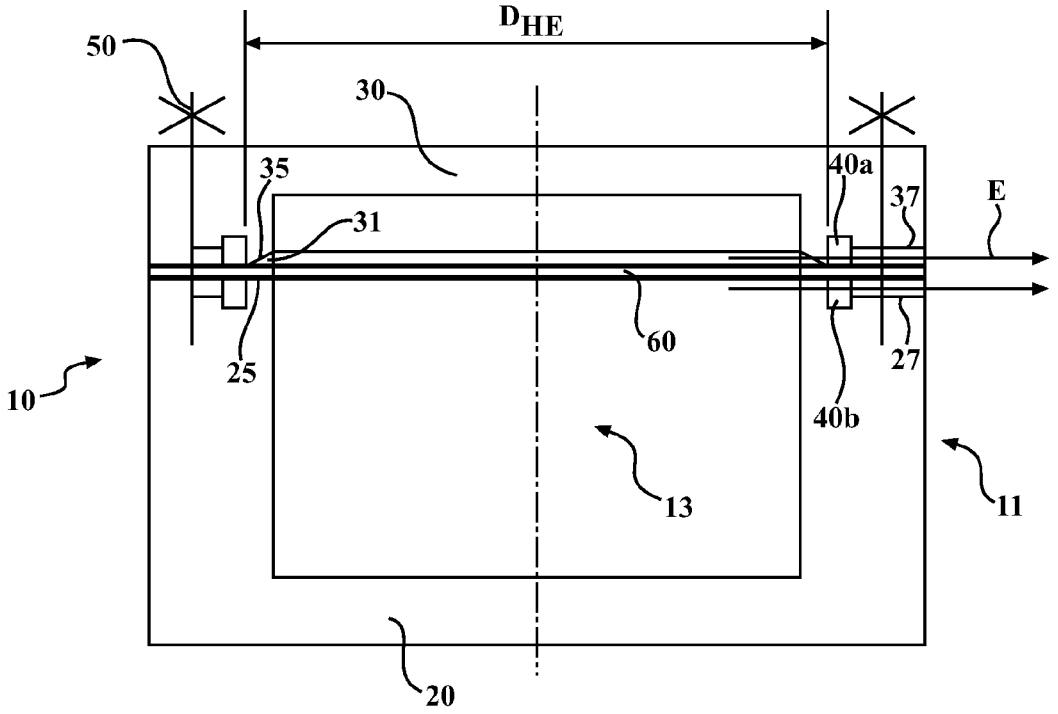
FIG. 5 illustrates a compressor including the relieving groove at maximum pressure according to another embodiment.

FIG. 5 shows a compressor 10 with a relieving groove at maximum pressure according to another embodiment. In the configuration shown here, the discharge of the pressurization medium E from the grooves 40*a* and 40*b* is done also via the relieving channels 27 and 37 in the sealing face 25 of the housing 20 and the sealing surface 35 of the housing cover 30. In regard the sealing surfaces, the relieving channels 27 and 37 are arranged along the grooves 40*a* and 40*b*, 50 not on the circumferential positions of the housing screws, but on the circumferential positions between the connecting elements. The relieving channels 27 and 37 in this case extend radially from the grooves 40*a* and 40*b* to the outer radial edge of that housing part 20 or 30, from which they are excluded, and thus establish a connection to the environment 11 of the compressor at ambient pressure, to which the pressurized medium E can be discharged from the pressure chamber of the compressor 13 via the gap 31, the grooves 40*a* and 40*b* and the relieving channels 27 and 37. For the described embodiment, one or more pairs of relieving channels 27 and 37 are provided. Further, one or more relieving channels 27 and/or 37 can be provided independently at any position in the circumference of the respective sealing surface 25 and/or 35.

FIG. 6 shows a compressor 10 with a relieving groove at maximum pressure according to another embodiment. The embodiment shown here differs from the embodiments shown in FIGS. 4 and 5 by the arrangement and the configuration of the relieving channels. The embodiment shown in FIG. 6 provides for one or more relieving channels 27 and/or 37 at the circumferential positions of the housing screws 50. The relieving channels 27 and/or 37 extend radially from the grooves 40*a* and 40*b* up to the radial position of the respective screw through hole 32. In addition, in the housing cover 30, one or more relieving borings 38 are provided, which extend radially from the screw through hole 32 to the environment 11 of the compressor 10. The relieving borings 38 are not disposed in the sealing surface of the housing cover, that is in the surface of the housing cover, but entirely within the boundaries of the volume of the housing cover 30. The pressurization medium E, which escapes at maximum pressure from the pressure chamber 13 of the compressor 10, can be collected in the grooves 40*a* and 40*b* and then be discharged via the relieving channels 27 and/or 37, via respective screw through holes 32 and relieving borings 38 into the environment 11 of the compressor 10. If this way of the pressurization medium E to be discharged shall be ensured, the part of screw through holes 32 distal to the pressure chamber must be closed beyond the axial screw position of the relieving borings in the housing cover 38 and made impermeable for the pressurization medium. In this case, the housing cover 30 includes one or more partially closed screw through holes 33.

FIG. 7*a* shows a radial pressure gradient in the sealing surface between the two housing parts of the typical compressor 10 at operating pressure. The sealing surface 135 of the housing cover 30 and the sealing surface 125 of the housing 20 rest on one another at the operating pressure. The radial pressure gradient in the sealing surface at the operating pressure $G_{BS}$ decreases over the entire sealing surface radially from the inside to the outside, wherein on the radially inner edge of the sealing surfaces of the full operating pressure is applied in the pressure chamber 12, and on the outer radial edge of the sealing surfaces the ambient pressure of the environment 11 is applied.

FIG. 7*b* shows the radial pressure gradient in the sealing surface between two housing parts of the typical compressor 10 for maximum pressure. When the maximum pressure is applied on the pressure chamber 13 of the compressor 10, the sealing surface 135 of the housing cover 30 and the sealing surface 125 of the housing 20 diverge with an acute angle, whereby the gap 31 is formed. As a result, in a radial area of the sealing surfaces from the inner edge of the radial sealing surface 125 and 135 near to the outer edge of the sealing surfaces, the full maximum pressure is applied on pressure chamber 13 at the sealing surfaces. Only in the outer radial edge of the sealing surfaces up to the outer edge of the sealing surfaces, the radial pressure gradient $G_{HS}$ in the sealing surface at the maximum pressure shows an idealized linearly decreasing curve up to the environment 11 of the compressor 10 under ambient pressure.

FIG. 7*c* shows the radial pressure gradients in the sealing surfaces 25 and 35 between two housing parts 20 and 30 of the compressor according to some embodiments for the operating pressure and for the maximum pressure 10. In the configuration shown here, the sealing surface 25 of the housing 20 and the sealing surface 35 of the housing cover have each a groove 40*a* and 40*b*, respectively extending in circumferential direction. The radial pressure gradients in the sealing surface at the operating pressure $G_{BE}$ and at the maximum pressure $G_{HE}$ are in contrast to the corresponding pressure gradients for the typical compressor limited radially on the range between the inner edge radial of the sealing surfaces and the radial position of the grooves 40*a* and 40*b*. Concerning the radial extension of the sealing surfaces, the ambient pressure of the environment 11 is applied to from the radial position of the grooves 40*a* and 40*b*.

According to at least one of the disclosed embodiments, the maximum pressure can be predetermined by a relatively simple safety device, against which the connecting device applies a contact pressure force between the housing parts. Thus, under the same conditions, it is possible to have a connecting device with smaller dimension compared to the conventional compressors resulting in cost and space benefits.

Furthermore, the axial compression force between two housing parts can be limited, the axial compression force being in relation to the longitudinal axis of the compressor, compared to conventional technology such as in DE 198 07 691 A1 where only a radial force can be avoided. This limitation of the axial compression force allows, for example, a smaller dimensioning of the connecting device between the housing parts without that inside of the compressor the contact force falls below the minimum contact pressure between the housing parts necessary to maintain the pressure chamber.

In addition, the groove extending in the circumferential direction, for example, does not need to have a sealing function and that it therefore can be configured in regard to its function of a pressure reduction.

While the above description has pointed out features of various embodiments, the skilled person will understand that various omissions, substitutions, and changes in the form and details of the device or process illustrated may be made without departing from the scope of the appended claims.

What is claimed is:

1. A compressor with a pressure chamber, which is delimited by at least two housing parts for use in an air conditioning system of a motor vehicle, wherein the housing parts comprise a plurality of sealing surfaces, which are connected by a connecting device applying a contact pressure on the sealing surfaces, at least one groove arranged on at least one of the sealing surfaces and extending in a circumferential direction, at least one vent opening arranged on at least one of the housing parts and extending from the groove to connect the groove with the environment of the compressor, and wherein the groove is arranged in such a way that on exceeding a predefined pressure in the pressure chamber a pressurization medium is collected in the groove and at least partially discharged via the vent opening, wherein the plurality of sealing surfaces includes a first sealing surface and a second sealing surface, and wherein the at least one groove includes a first groove arranged on the first sealing surface and a second groove arranged on the second sealing surface.

2. The compressor according to claim 1, wherein the connecting device comprises a plurality of connecting elements.

3. The compressor according to claim 2, wherein the connecting elements protrude through recesses in the sealing surfaces of the housing parts to be connected.

4. The compressor according to claim 3, wherein the recesses are arranged at substantially equal distances from an edge contour of the sealing surfaces facing the pressure chamber.

5. The compressor according to claim 4, wherein in regard to the recesses for the connecting elements the groove has a larger or a smaller or a substantially identical distance from the pressure chamber.

6. The compressor according to claim 4, wherein in regard to the recesses for the connecting elements the groove has a variable distance from the pressure chamber.

7. The compressor according to claim 4, further comprising at least one sealing element arranged in the at least one groove.

8. The compressor according to claim 3, wherein the connecting elements comprise screws or bolts and are inserted into the recesses in at least one of the housing parts which lead into the recesses in the sealing surfaces.

9. The compressor according to claim 8, wherein the vent opening has at least one relieving opening, which extends from at least one of the recesses to the environment of the compressor, and wherein the relieving opening is spaced apart from the sealing surfaces.

10. The compressor according to claim 3, wherein the vent opening comprises at least one relieving channel in at least one of the sealing surfaces of the housing parts, and wherein the relieving channel extends from the groove to the environment of the compressor.

11. The compressor according to claim 3, wherein the vent opening comprises at least one relieving channel, wherein the relieving channel extends from the groove to the recesses for the connecting elements, and wherein the pressurization medium is configured to be discharged via at least one of the recesses.

12. The compressor according to claim 2, wherein at least one of the connection elements is constructed and arranged in such a way that the medium accumulated in the groove is discharged into the environment of the compressor.

13. The compressor according to claim 1, wherein the at least one groove is disposed between the pressure chamber and the connecting device.

14. The compressor according to claim 1, wherein the at least two housing parts include a first housing part and a second housing part, and where the at least one vent opening includes a first vent channel arranged on the first housing part and extending from the first groove and a second vent channel arranged on the second housing part and extending from the second groove.

15. The compressor according to claim 14, wherein the first housing part includes a housing and the second housing part includes a housing cover.

16. A compressor with a pressure chamber, which is delimited by at least two housing parts for use in an air conditioning system of a motor vehicle, wherein the housing parts comprise a plurality of sealing surfaces, which are connected by a connecting device applying a contact pressure on the sealing surfaces, at least one groove arranged on at least one of the sealing surfaces and extending in a circumferential direction, at least one vent opening arranged on at least one of the housing parts and extending from the groove to connect the groove with the environment of the compressor, and wherein the groove is arranged in such a way that on exceeding a predefined pressure in the pressure chamber a gap opens between the plurality of sealing surfaces radially outwardly from the pressure chamber to the at least one groove and a pressurization medium is collected in the groove and serially discharged via the gap, the at least one groove, and the at least one vent opening to the environment, wherein the plurality of sealing surfaces include a first sealing surface and a second sealing surface, and wherein the at least one groove includes a first groove arranged on the first sealing surface and a second groove arranged on the second sealing surface.

17. The compressor according to claim 16, wherein the connecting device includes a plurality of connecting elements each protruding through recesses in the sealing surfaces of the at least two housing parts, and the at least one vent opening has at least one relieving opening which extends from at least one of the recesses to the environment of the compressor.

18. The compressor according to claim 16, wherein the connecting device includes a plurality of connecting elements each protruding through recesses in the sealing surfaces of the at least two housing parts, and wherein the at least one vent opening comprises at least one relieving channel in at least one of the sealing surfaces and extending from the at least one groove to the environment of the compressor.

19. The compressor according to claim 16, wherein the connecting device includes a plurality of connecting elements, and wherein at least one of the connecting elements is constructed and arranged in such a way that the pressurization medium accumulated in the groove is discharged into the environment of the compressor.

20. A compressor for use in an air conditioning system of a motor vehicle, comprising:

a housing including a first housing part and a second housing part which together define a pressure chamber, said first housing part having a first sealing surface and said second housing part having a second sealing surface, said first and second housing parts being connected by a plurality of connecting elements applying a contact pressure on said first and second sealing surfaces;

a first groove formed in said first sealing surface of said first housing part and extending in a circumferential direction;

a second groove formed in said second sealing surface of said second housing part and extending in a circumferential direction, said second groove being aligned with said first groove;

at least one vent opening arranged on at least one of said first and second housing parts and extending from a corresponding one of said first and second grooves to the environment of the compressor; and wherein said first and second grooves are arranged such that a pressurized medium is collected in said first and second grooves and is at least partially discharged via said vent opening to the environment in response to the pressurized medium within said pressure chamber exceeding a predetermined pressure.

* * * * *